US008579471B2

(12) United States Patent
Boomgaarden et al.

(10) Patent No.: US 8,579,471 B2
(45) Date of Patent: Nov. 12, 2013

(54) PENDANT LUMINAIRE

(75) Inventors: Mark Penley Boomgaarden, Satellite Beach, FL (US); Addy S. Widjaja, Palm Bay, FL (US); Shane Sullivan, Indialantic, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 171 days.

(21) Appl. No.: 13/102,360

(22) Filed: May 6, 2011

(65) Prior Publication Data

US 2011/0273889 A1 Nov. 10, 2011

Related U.S. Application Data

(60) Provisional application No. 61/332,098, filed on May 6, 2010.

(51) Int. Cl.
*H01K 1/62* (2006.01)
*H01K 1/58* (2006.01)

(52) U.S. Cl.
USPC ..... 362/294; 362/373

(58) Field of Classification Search
USPC ..... 362/294, 217.02–217.17, 362/311.01–311.15, 373
See application file for complete search history.

(56) References Cited

U.S. PATENT DOCUMENTS

| | | | | |
|---|---|---|---|---|
| 6,746,137 | B1 * | 6/2004 | Yeh | 362/352 |
| 7,637,643 | B2 | 12/2009 | Maxik | |
| 7,922,356 | B2 | 4/2011 | Maxik et al. | |
| 2002/0107885 | A1 * | 8/2002 | Brooks et al. | 707/505 |
| 2003/0107885 | A1 * | 6/2003 | Galli | 362/205 |
| 2007/0285926 | A1 * | 12/2007 | Maxik | 362/294 |
| 2010/0027258 | A1 * | 2/2010 | Maxik et al. | 362/240 |
| 2010/0214770 | A1 * | 8/2010 | Anderson | 362/133 |

* cited by examiner

*Primary Examiner* — Karabi Guharay
*Assistant Examiner* — Nathaniel Lee
(74) *Attorney, Agent, or Firm* — Cantor Colburn LLP

(57) ABSTRACT

A luminaire includes an optics module and a heat sink. The optics module includes a body, an LED light source, an electronic driver circuit, and a holder. The LED light source is thermally coupled to the body. The electronic driver circuit is disposed within the body and is electrically connected to the LED light source, the driver circuit having an electrical connector configured to receive electrical power from a power source. The holder is mechanically secured to the body, the LED light source being securely retained between the holder and the body. The heat sink has a plurality of radially projecting fins and is thermally and removably coupled to the body of the optics module.

16 Claims, 9 Drawing Sheets

Section A-A

Section A-A

PENDANT LUMINAIRE

CROSS REFERENCE TO RELATED APPLICATIONS

This application claims the benefit of U.S. Provisional Application Ser. No. 61/332,098, filed May 6, 2010, which is incorporated herein by reference in its entirety.

BACKGROUND OF THE INVENTION

The present invention relates generally to conducting and dissipating heat from a light source, more particularly to effectively dissipating heat from a light source via a heat conducting element and an independent heat dissipating element that allows for economical replacement of an optics module at the end of the lifespan of the light source disposed within the optics module, further particularly to a pendant luminaire, and even more particularly to a pendant luminaire having a light emitting diode (LED) light source and a heat dissipating apparatus.

A variety of different types of light bulbs and other light sources are commercially available. The most common type of light source is the incandescent light bulb, in which electric current is passed through a metal filament disposed in a vacuum, causing the filament to glow and emit light. Another common type of light bulb is the fluorescent light.

A problem with the standard light bulbs having resistive heating elements (e.g. tungsten) is that such a light source expends more energy as heat than as light. Fluorescent lamps run substantially cooler, but have a substantial lag time between when they are initially turned on and when they actually start emitting light, and are often fairly bulky. Halogen lamps are highly efficient, but need to be handled very carefully and generate a considerable amount of heat when manufactured large enough to provide a usable amount of light, even when powered with low voltage (e.g. 12V).

Recent developments in lighting technology involve the expanded use of light emitting diodes (LEDs) that are quite efficient in that they are able to convert virtually all of their supply voltage into light, thereby producing less heat and requiring less overall power consumption. In addition, LEDs may be very small and have an extremely long service life, mainly due to the fact that they operate at cooler temperatures. Compared with a traditional light bulb, an LED lamp may have a lifespan of about 50 to about 100 times that of the traditional light bulb, and the power consumption of such an LED lamp may be about one third to about one fifth that of the traditional light bulb.

General LED light sources are well known in the art. LEDs are light sources based upon a semiconductor structure, specifically a diode structure, which emit incoherent light (which may be in the ultraviolet, visible, or infrared spectrum) when electrical current is passed through the semiconductor junction. One example of such a light source may include phosphors emitting white light. Recent developments in LED technology have increased the output power and efficiency of LED sources so that it is now feasible for them to be utilized in traditional lighting applications previously reserved for incandescent, fluorescent, sodium, and other known lighting technologies.

One current drawback with such LED lamps is that when used to replace a conventional incandescent bulb they must have special driving circuits that convert the incoming alternating-current line voltage to the direct-current low voltage needed by the lamp. Such a circuit is normally a small printed-circuit board that is permanently mounted right in the lamp and to which the LED is normally directly soldered. These circuits typically incorporate a transformer to step down the incoming voltage and a rectifier and similar power-supply elements that produce the necessary steady low voltage. The problem with such a construction is that the driving circuit itself generates heat, particularly when the LED requires some meaningful amperage, albeit at low voltage. Above a temperature of about 25 degrees Celsius, an LED operates less efficiently and produces less light than at lower temperatures. In particular, as the operating temperature progressively increases above 25 degrees Celsius, the light output of the LED progressively decreases. Since the LED itself is typically carried right on the circuit board, when the circuit elements heat up, the LED is heated. Unfortunately the efficiency of an LED falls off rapidly as it gets hot, and thus known LED lamps tend to dim somewhat after they have been in use for a while and their driving circuits have gotten warm.

In order to manage heat, the prior art has attempted to utilize a variety of heat-dissipation techniques, such as an LED attached to a heat sink via heat conductive adhesive, but if the LED stops working, then the entire component must be discarded, making parts replacement costly. Such LEDs are not exchangeable or serviceable and are therefore rendered disposable and very inefficient.

It is desirable that light sources make use of the currently available LED technology due to the significant benefits that such light sources provide including extremely long life, the ability to control output power and spectrum, and a significant reduction in the amount of electrical energy consumed for equivalent light output power. It is also desirable that such light sources be fabricated from materials that are inexpensive and preferably comprise re-usable, recyclable, or replaceable components so as to require a minimum of new raw material and thus preserve limited natural resources. However, utilizing LED light sources in contemporary light sources gives rise to the significant challenge of removing the heat from the LED semiconductor junction and surrounding structures.

While existing LED light sources may be suitable for their intended purpose, there remains, however, a need in the art for an LED light source that provides an improved arrangement for servicing and/or replacement of the illuminating element independent from the heat dissipating element so as to be environmentally friendly and lower overall maintenance and/or replacement costs relative to present illumination apparatus, while at the same time providing for ease of manufacturing.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment of the invention includes a luminaire having an optics module and a heat sink. The optics module includes a body, an LED light source, an electronic driver circuit, and a holder. The LED light source is thermally coupled to the body. The electronic driver circuit is disposed within the body and is electrically connected to the LED light source, the driver circuit having an electrical connector configured to receive electrical power from a power source. The holder is mechanically secured to the body, the LED light source being securely retained between the holder and the body. The heat sink has a plurality of radially projecting fins and is thermally and removably coupled to the body of the optics module.

An embodiment of the invention includes a product having any feature described herein, explicitly or equivalently, either individually or in combination with any other feature, in any configuration.

An embodiment of the invention includes a method of forming the aforementioned product, including any process or sub-process described herein, explicitly or equivalently, or impliedly, in any order, using any modality suitable for the purpose disclosed herein.

BRIEF DESCRIPTION OF THE DRAWINGS

Referring to the exemplary drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

An embodiment of the invention, as shown and described by the various figures and accompanying text, provides pendant type luminaire having a light emitting diode (LED) light source module separably connected to a heat sink, which in combination is supportable from a ceiling fixture or track light fixture. While the embodiment described herein depicts a particular geometry for an example luminaire, such as an MR16 lamp for example, it will be appreciated that the disclosed invention is also applicable to other luminaire geometries, such as an MR11 lamp for example.

Figure 1:
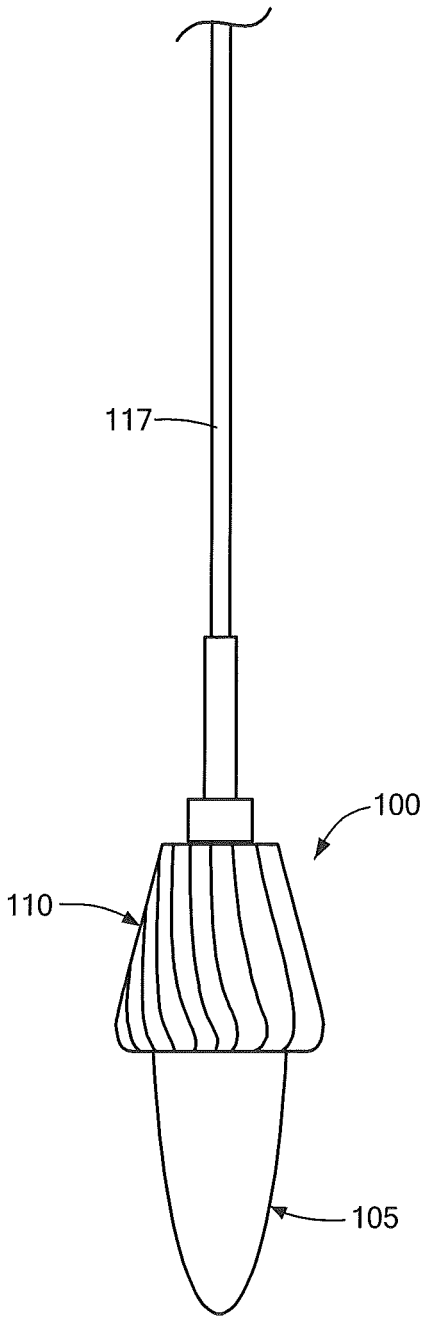
FIG. 1 depicts in front view an example pendant luminaire in an end-use installed configuration.
Figure 2:
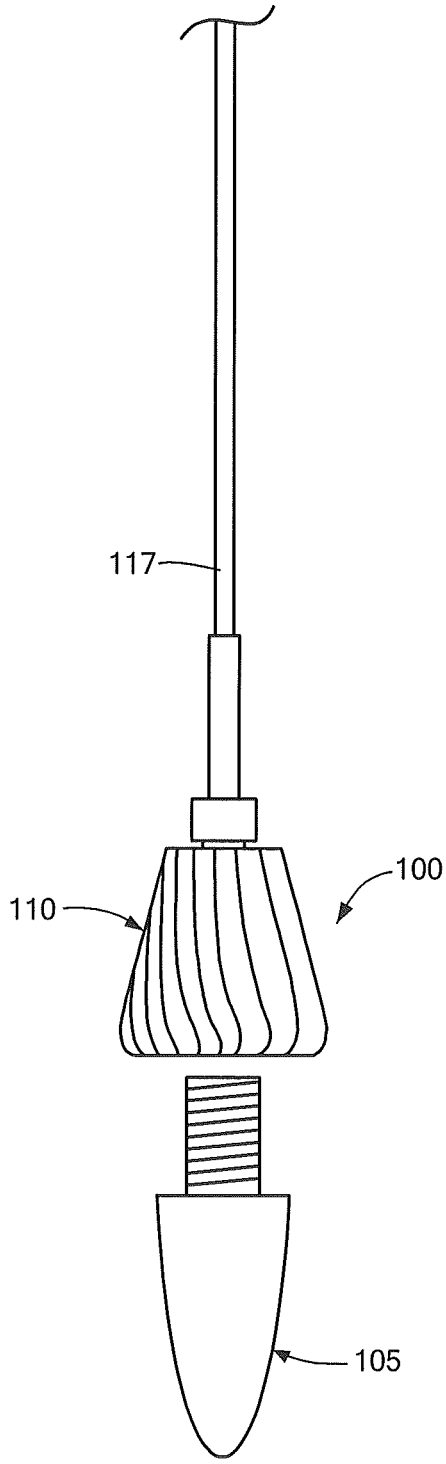
FIG. 2 depicts in front view the luminaire of FIG. 1 is a partially disassembled state.
Figure 3A:
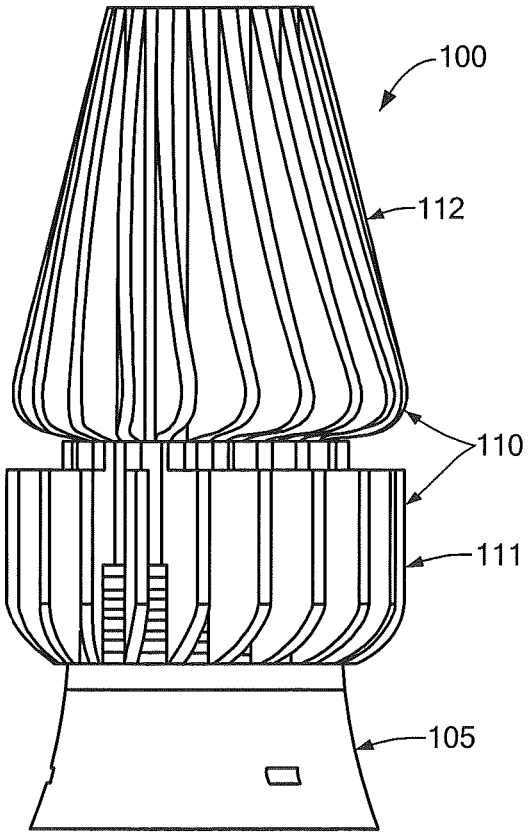
FIG. 3A depicts a side orthogonal view of an example pendant luminaire in accordance with an embodiment of the invention.
Figure 3B:
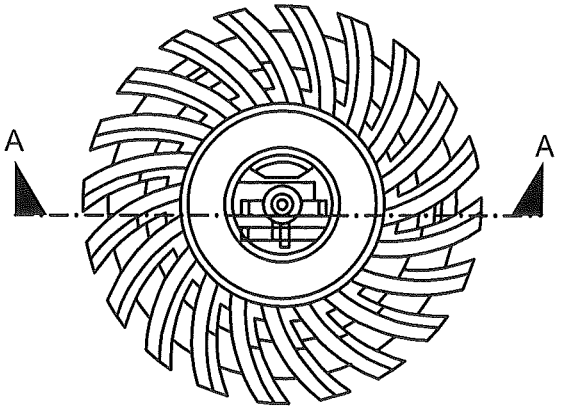
FIG. 3B depicts a top orthogonal view of the example pendant luminaire of FIG. 3A.
Figure 3C:
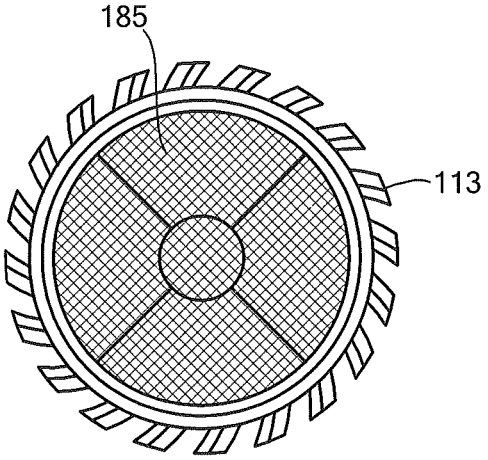
FIG. 3C depicts a bottom orthogonal view of the example pendant luminaire of FIG. 3A.
Figure 3D:
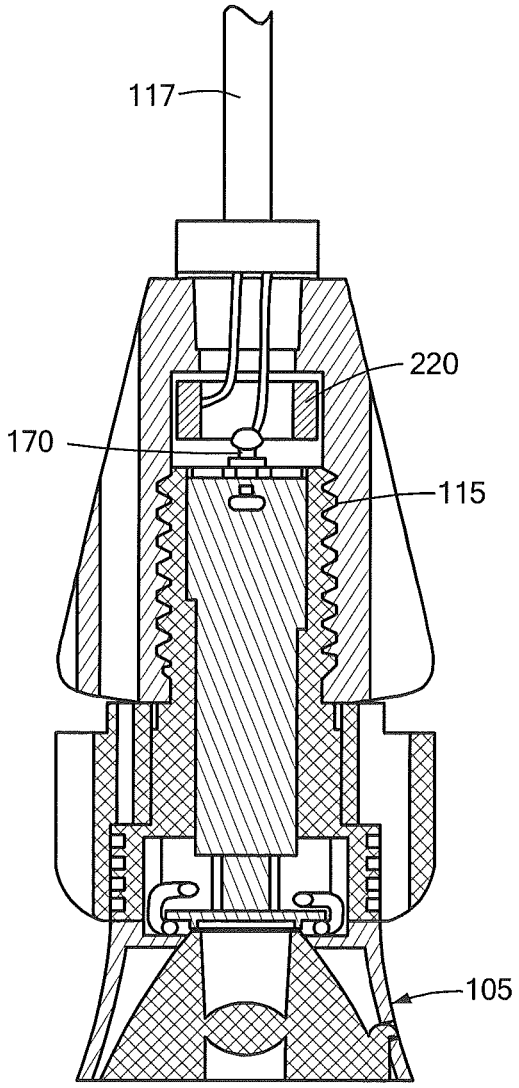
FIG. 3D depicts a cross section view of the example pendant luminaire of FIG. 3A.

FIGS. 1 and 2 depict a general form of a pendant luminaire 100 having an optics module 105 and a heat sink 110 that is removably coupled to the optics module. An electrical supply wire 117 provides electrical power to the luminaire 100 and also has sufficient structural integrity (in a manner known to one skilled in the art) to support the luminaire 100 when it is installed suspended from a ceiling junction box or from a ceiling track light fixture.

Figure 6:
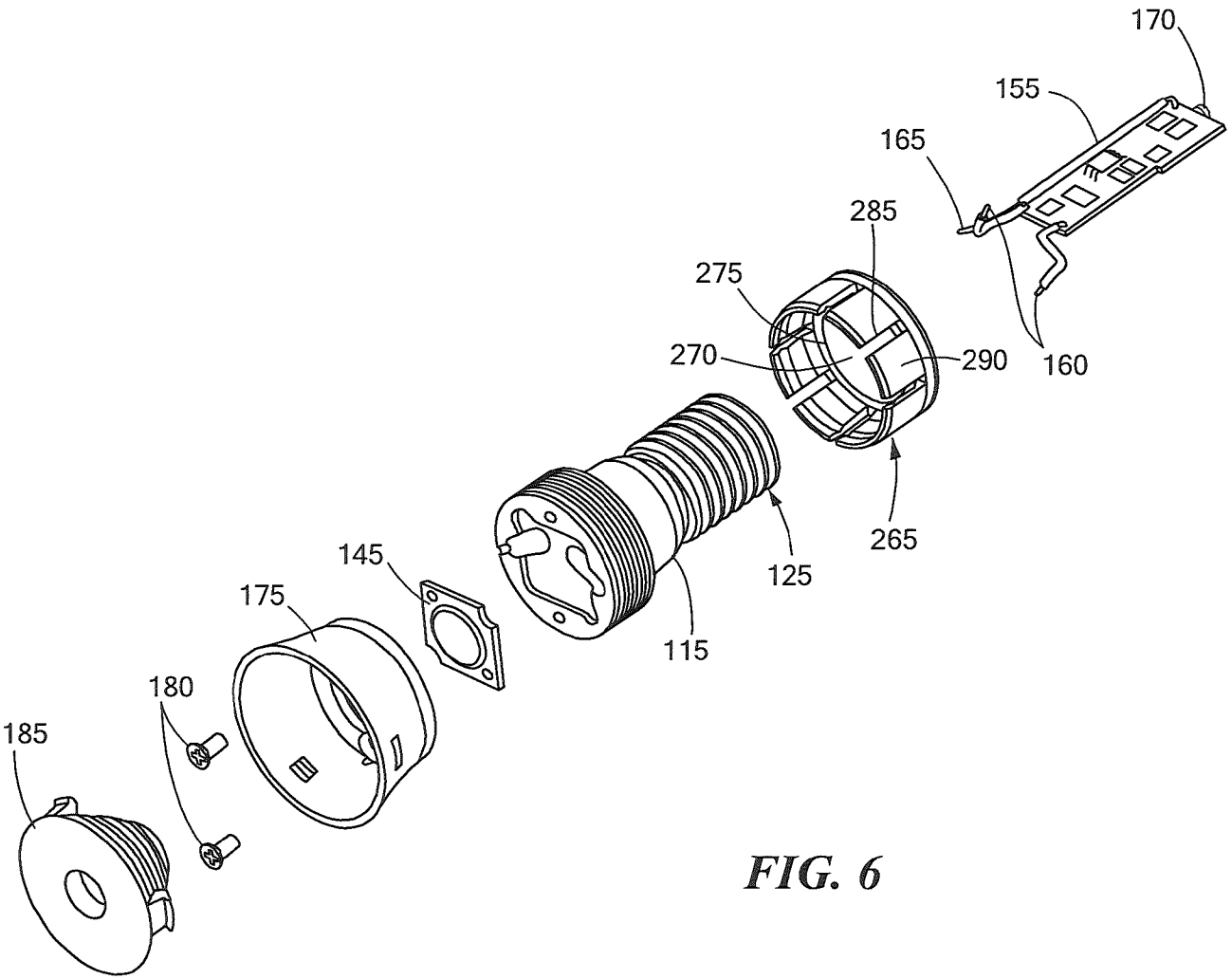
FIG. 6 depicts an exploded assembly view of the luminaire of FIG. 5.
Figure 7:
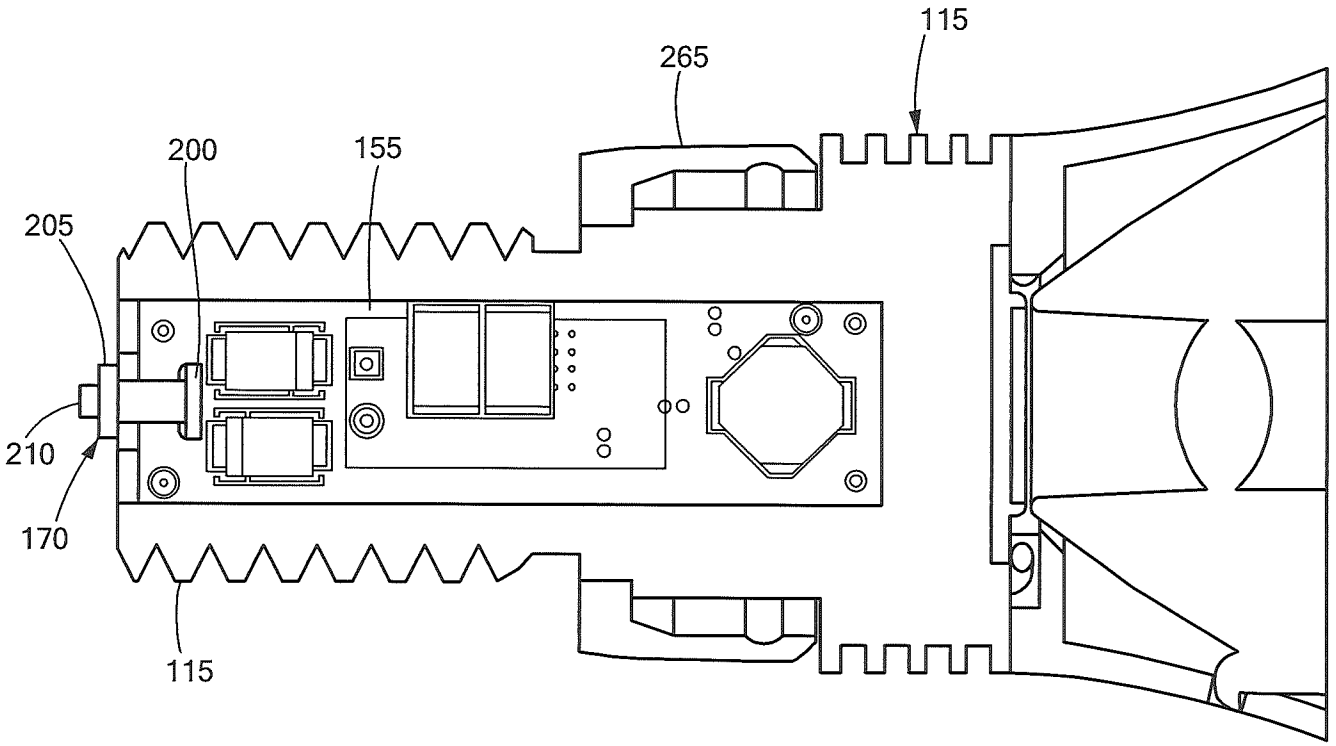
FIG. 7 depicts a first cross section view of the luminaire of FIGS. 5 and 6.
Figure 8:
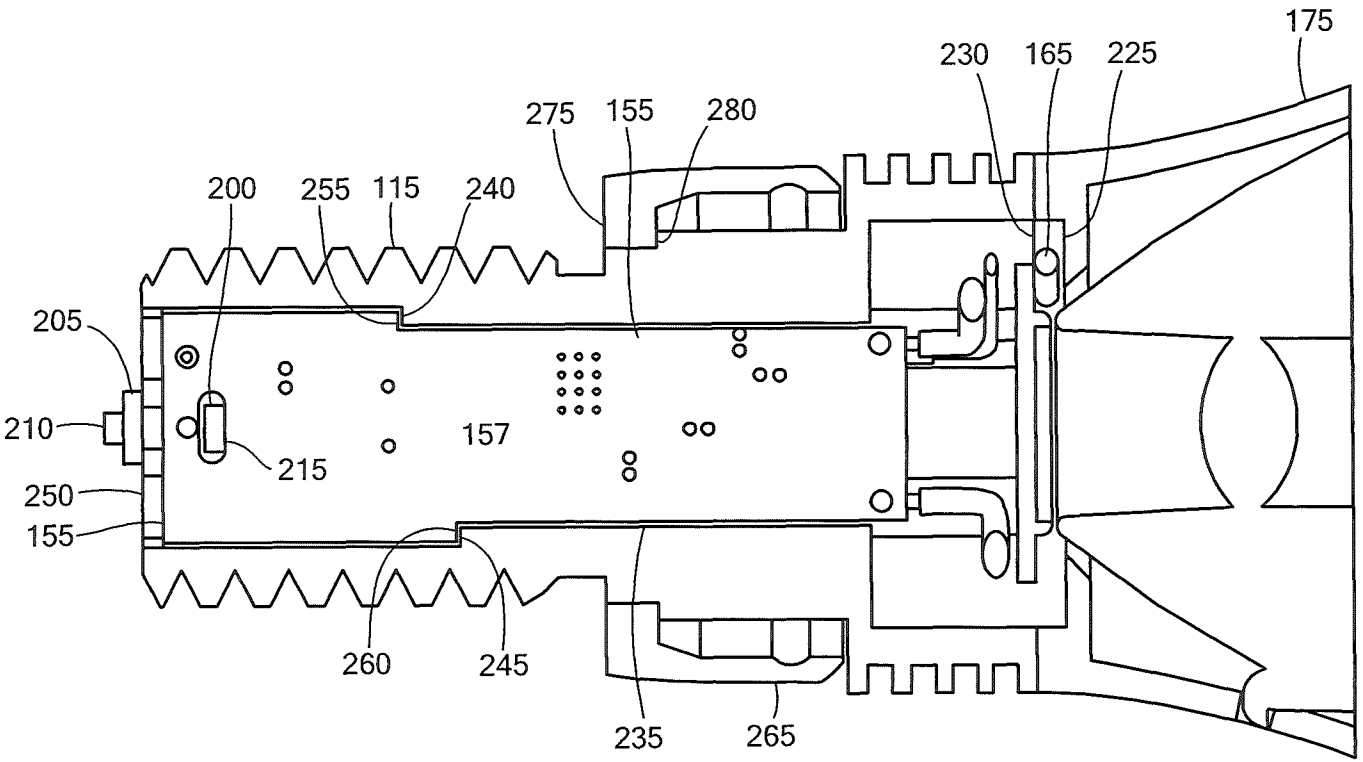
FIG. 8 depicts a second cross section view of the luminaire of FIGS. 5 and 6, seen from the opposite side of that of FIG. 7.

FIGS. 3-8 (where reference to FIG. 3 and FIG. 5 means reference to FIGS. 3A-3D and FIGS. 5A-5D, respectively) depict in more detail the pendant luminaire 100 (in alternative form to that depicted in FIGS. 1 and 2) having optics module 105 and removable heat sink 110, or portions thereof FIGS. 5-8 exclude the heat sink 110, but includes a lampshade holder 265 (depicted in FIGS. 6-8). The following description is made with reference to FIGS. 3-8.

Figure 4:
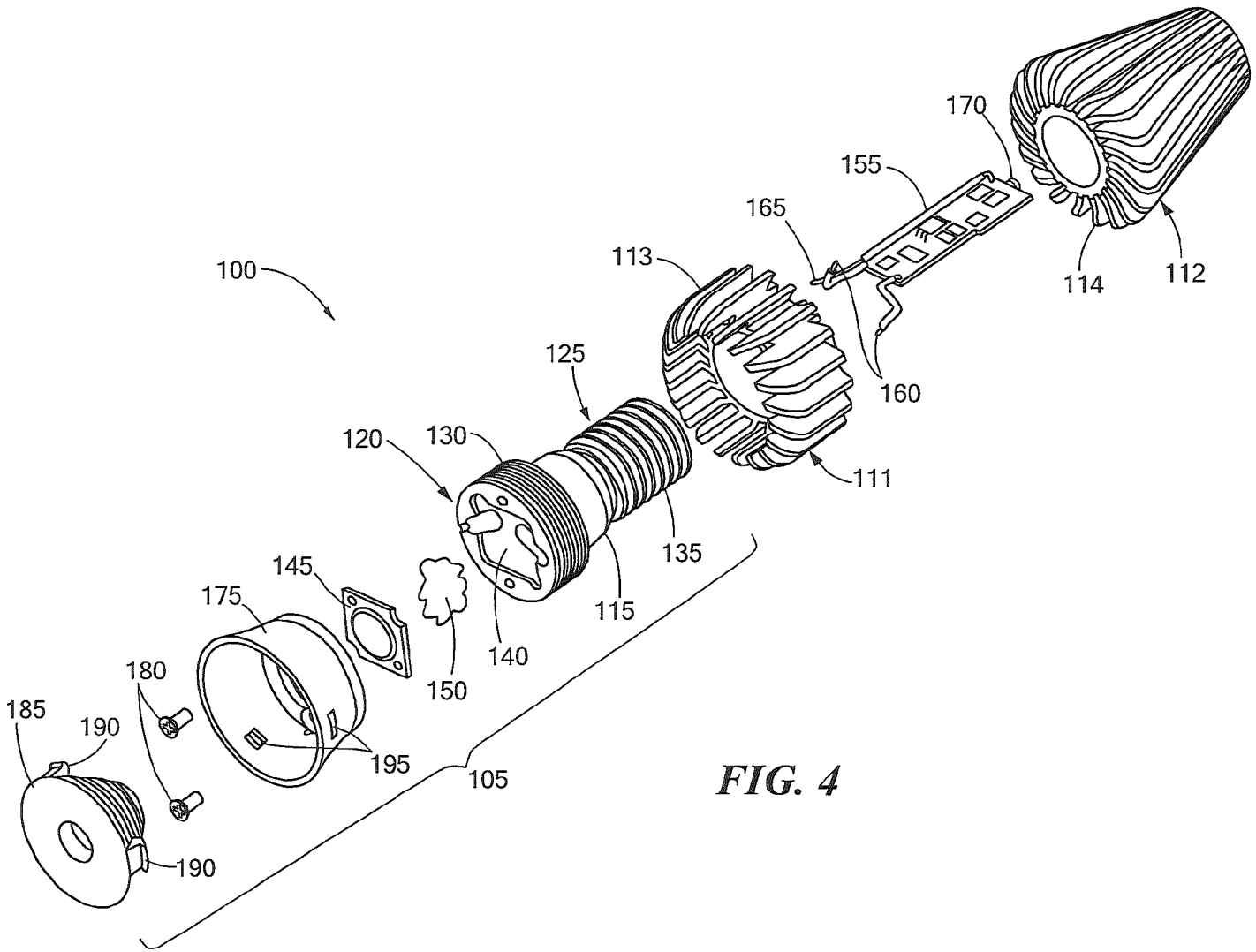
FIG. 4 depicts an exploded assembly view of the luminaire of FIG. 3.
Figure 5A:
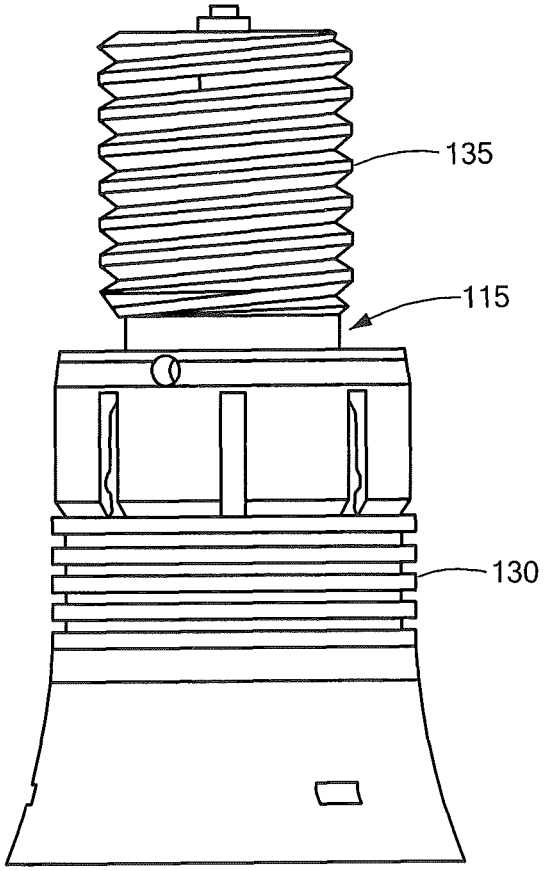
FIG. 5A depicts a side orthogonal view of the luminaire of FIG. 3A with heat sinks removed.
Figure 5B:
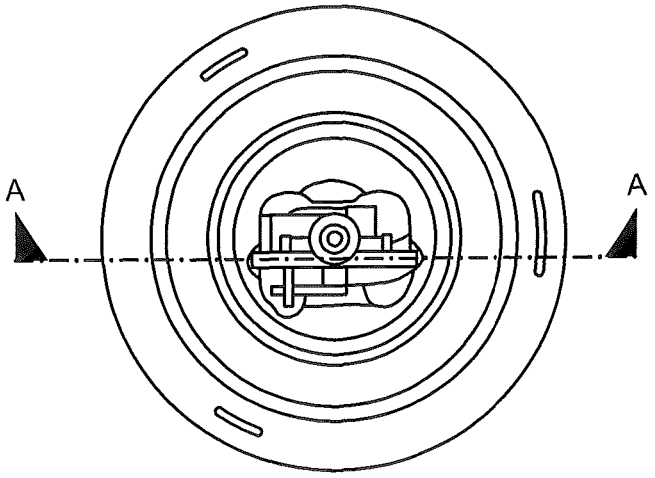
FIG. 5B depicts a top orthogonal view of the luminaire of FIG. 3B with heat sinks removed.
Figure 5C:
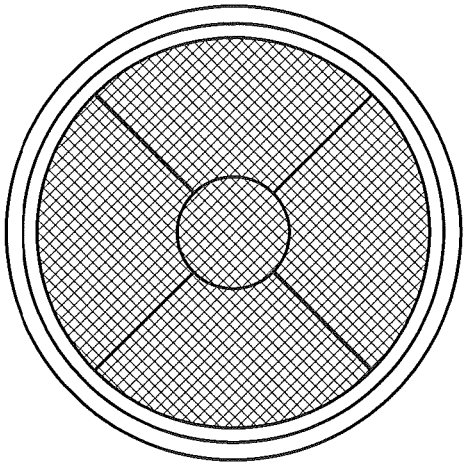
FIG. 5C depicts a bottom orthogonal view of the luminaire of FIG. 3C with heat sinks removed.
Figure 5D:
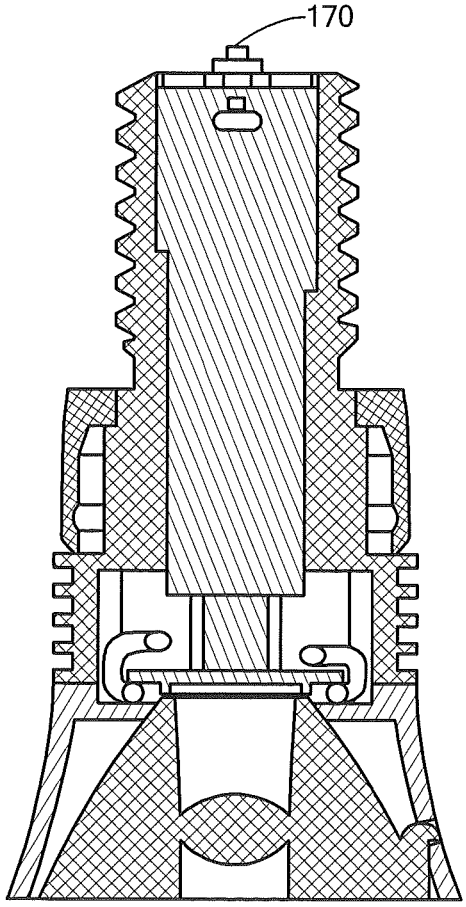
FIG. 5D depicts a cross section view of the luminaire of FIG. 3D with heat sinks removed.

With reference to FIGS. 3 and 4, optics module 105 includes a body 115 having a first end 120 and a second end 125, with a first threaded portion 130 at the first end 120, and a second threaded portion 135 at the second end 125. A land surface 140 is formed in the body 115 at the first end 120, and is configured to receive an LED light source 145 disposed thereat, the LED light source 145 being thermally coupled to the body 115 once the luminaire 100 is fully assembled. To promote desirable heat transfer from the LED light source 145 to the body 115, a thermally conductive paste 150 may be disposed therebetween.

Heat sink 110 includes a first heat sink 111 and a second heat sink 112, with each heat sink 111, 112 having a plurality of radially projecting fins 113, 114, respectively, configured for both heat dissipation and aesthetic appeal. The first heat sink 111 is threadably coupled to the first threaded portion 130 of the body 115, and the second heat sink 112 is threadably coupled to the second threaded portion 135 of the body 115. With appropriately dimensioned internal and external threads, the first and second heat sinks 111, 112 are thermally coupled to the body 115 while being removable from the body 115. In an embodiment, the first and second heat sinks 111, 112 and the body 115 are each made from aluminum.

Disposed within the body 115 is an electronic driver circuit 155 that is electrically connected to the LED light source 145 via wires 160. A grounding wire 165 is also provided, which will be discussed in more detail below. Connected at an end of the driver circuit 155 is an electrical connector 170 that is configured to receive electrical power from a power source via supply wire 117. An optic holder 175 is mechanically secured to the body 115 via fasteners 180. Holder 175 securely retains the LED light source 145 with respect to the body 115 by virtue of the LED light source 145 being captured between the holder 175 and the body 115. Holder 175 also securely retains an optic (color mixing and dispersion lens) 185 that is disposed within the holder 175 and held in place via snap-fit legs 190 (three used, two illustrated) on the optic 185 engaging with snap-fit receptacles 195 on the holder 175.

Referring now to FIGS. 3, 7 and 8 in combination, the electrical connector 170 is a dumbbell shaped connector having a first dumbbell arm 200 at one end, and a second dumbbell arm 205 and a post 210 at a second opposing end. The first dumbbell arm 200 at the one end mechanically engages with the body 115 and electrically engages with an edge conductor 215 of the driver circuit 155. The second dumbbell arm 205 at the second end mechanically engages with the body 115, and the post 210 at the second end extends a defined distance from the body 115 to engage with an electrical connector 220 disposed in electrical communication with the supply wires 117 (see FIG. 3, Section A-A for example). With such a dumbbell-shaped electrical connector 170, good dimensional control for the extension of the post 210 relative to the body 115 can be achieved for positive electrical engagement with the electrical connector 220 of supply wires 117, and a good electrical connection can be achieved between the post 210 and the edge conductor 215 of the driver circuit 155.

Referring to FIG. 8, an embodiment of the invention utilizes a grounding means where the grounding wire 165 is compressively retained between a surface 225 of the holder 175 and a surface 230 of the body 115. Holder 175 may also be made of an opaque polymer material, thereby acting as a light diffuser. As such, holder 175 becomes a multi-functional part; a retainer for the LED light source 145, a retainer for the optic 185, a retainer for the grounding wire 165, and a light diffuser.

Still referring to FIG. 8, the outside profile of the circuit board 157 of the driver circuit 155, and the interior profile of the retaining pocket 235 of the body 115 that receives the driver circuit 155, are so dimensioned and configured as to prevent reverse installation of the driver circuit 155 into the pocket 235, and to provide dimensional control for the degree of insertion of the driver circuit 155 into the pocket 235. For example, the pocket 235 includes a first step 240 and a second step 245 in the interior sidewall that are at different distances from the end 250 of the body 115, and the circuit board 157 includes mating first and second tabs 255, 260 that engage with the first and second steps 240, 245, such that if the circuit board 157 was to be inserted 180-degrees rotated, the second tab 260 would prematurely mate with the first step 240 thereby preventing complete insertion.

As seen from FIGS. 7 and 8, an embodiment includes a circuit board 157 where all of the electronic components of the driver circuit 155 are disposed on only one side of the circuit board 157.

Referring briefly to FIGS. 6-7, an embodiment includes a lampshade holder 265 with an opening 270 that slides over the second end 125 of the body 115, and a flange 275 that sits on a shoulder 280 of the body 115. When so positioned, slots 285 and fingers 290 of the holder 265 provide a flexible support structure for a lampshade (not shown) to frictionally engage with the holder 265 to provide for additional lighting effects.

While certain combinations of elements have been described herein, it will be appreciated that these certain combinations are for illustration purposes only and that any combination of any of the elements may be employed when arranged in accordance with an embodiment of the invention. Any and all such combinations are contemplated herein and are considered within the scope of the invention disclosed.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A luminaire, comprising:

an optics module; and a heat sink comprising a plurality of radially projecting fins;

the optics module comprising:

a body;

an LED light source thermally coupled to the body;

an electronic driver circuit disposed within the body and electrically connected to the LED light source, the driver circuit comprising an electrical connector configured to receive electrical power from a power source; and a holder mechanically secured to the body, the LED light source being securely retained by and between the holder and the body;

wherein the heat sink is thermally and removably coupled to the body of the optics module;

wherein the driver circuit comprises a circuit board comprising a first tab and a second tab, the first tab being offset from the second tab;

wherein the body comprises an internal pocket comprising a first step and a second step, the first step being offset from the second step; and wherein the first tab is disposed proximate to or in engagement with the first step, and the second tab is disposed proximate to or in engagement with the second step, at least one of the first tab and the second tab, and at least one of the first step and the second step, determining a degree of insertion of the circuit board into the internal pocket of the body.

2. The luminaire of claim 1, further comprising:

an optic disposed within and retained by the holder.

3. The luminaire of claim 1, wherein the driver circuit comprises a grounding wire compressively retained between the holder and the body.

4. The luminaire of claim 3, wherein the grounding wire is compressively retained between a surface of the holder and a surface of the body.

5. A method of assembling the luminaire of claim 3, comprising:

inserting the electronic driver circuit into the body, the driver circuit comprising a grounding wire;

placing the LED light source on the body in electrical communication with the electronic driver circuit;

securing the holder to the body such that the LED light source is securely retained between the holder and the body, and such that the grounding wire is compressively retained between the holder and the body; and removably coupling the heat sink to the body.

6. The luminaire of claim 3, wherein;

the driver circuit is electrically connected to the LED light source via a pair of wires.

7. The luminaire of claim 1, wherein the heat sink comprises:

a first heat sink comprising a first plurality of radially projecting fins, the first heat sink being threadably coupled to a first threaded portion of the body; and a second heat sink comprising a second plurality of radially projecting fins, the second heat sink being threadably coupled to a second threaded portion of the body.

8. The luminaire of claim 1, wherein the holder is made from an opaque polymer material.

9. The luminaire of claim 1, wherein:

the driver circuit comprises a circuit board comprising at least one tab;

the body comprises an internal pocket comprising at least one step; and the at least one tab is disposed proximate to or in engagement with the at least one step, the at least one tab and the at least one step determining a degree of insertion of the circuit board into the internal pocket of the body.

10. The luminaire of claim 1, wherein the optics module comprises a lampshade holder slidably attached to the body, the lampshade holder comprising a plurality of flexible fingers for supporting a lampshade.

11. The luminaire of claim 1, wherein the driver circuit comprises a circuit board having a first side, a second side, and a plurality of electronic components, the plurality of electronic components all being disposed on the first side of the circuit board.

12. A method of assembling the luminaire of claim 1, comprising:

inserting the electronic driver circuit into the body;

placing the LED light source on the body in electrical communication with the electronic driver circuit;

securing the holder to the body such that the LED light source is securely retained by and between the holder and the body; and removably coupling the heat sink to the body.

13. The luminaire of claim 1, wherein:

the first step and the second step are disposed at different distances from an end of the body.

14. A luminaire, comprising:

an optics module; and a heat sink comprising a plurality of radially projecting fins;

the optics module comprising:

a body;

an LED light source thermally coupled to the body;

an electronic driver circuit disposed within the body and electrically connected to the LED light source, the driver circuit comprising an electrical connector configured to receive electrical power from a power source; and a holder mechanically secured to the body, the LED light source being securely retained by and between the holder and the body;

wherein the heat sink is thermally and removably coupled to the body of the optics module;

wherein the electrical connector is dumbbell shaped with a dumbbell arm at one end, and a dumbbell arm and a post at a second opposing end, wherein the dumbbell arm at the one end mechanically engages with the body and electrically engages with the driver circuit, wherein the dumbbell arm at the second end mechanically engages with the body, and wherein the post at the second end extends a defined distance from the body.

15. A luminaire, comprising an optics module; and a heat sink comprising a plurality of radially projecting fins;

the optics module comprising:

a body;

an LED light source thermally coupled to the body;

an electronic driver circuit disposed within the body and electrically connected to the LED light source, the driver circuit comprising an electrical connector configured to receive electrical power from a power source;

a holder mechanically secured to the body, the LED light source being securely retained by and between the holder and the body; and an optic disposed within and retained by the holder;

wherein the heat sink is thermally and removably coupled to the body of the optics module;

wherein the optic comprises snap-fit legs and the holder comprises snap-fit receptacles, the snap-fit legs being removably engaged with snap-fit receptacles.

16. A luminaire, comprising:

an optics module; and a heat sink comprising a plurality of radially projecting fins;

the optics module comprising:

a body;

an LED light source thermally coupled to the body;

an electronic driver circuit disposed within the body and electrically connected to the LED light source, the driver circuit comprising an electrical connector configured to receive electrical power from a power source; and a holder mechanically secured to the body, the LED light source being securely retained by and between the holder and the body;

wherein the heat sink is thermally and removably coupled to the body of the optics module;

wherein the optics module comprises a lampshade holder slidably attached to the body, the lampshade holder comprising a plurality of flexible fingers for supporting a lampshade;

wherein the body comprises a shoulder;

wherein the lampshade holder comprises a flange; and wherein the flange is disposed to sit on the shoulder.

* * * * *